US007219461B1

(12) United States Patent
Keeney et al.

(10) Patent No.: US 7,219,461 B1
(45) Date of Patent: May 22, 2007

(54) BOLT ASSEMBLY WITH LOCKING SYSTEM

(75) Inventors: Michael D. Keeney, Rineyville, KY (US); Michael Brent Jarboe, Rineyville, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 11/496,374

(22) Filed: Jul. 31, 2006

Related U.S. Application Data

(63) Continuation of application No. 10/851,491, filed on May 21, 2004, now Pat. No. 7,107,715.

(60) Provisional application No. 60/473,277, filed on May 23, 2003.

(51) Int. Cl.
*F41A 3/26* (2006.01)

(52) U.S. Cl. ..... 42/16; 89/188

(58) Field of Classification Search ..... 42/16; 89/188

See application file for complete search history.

(56) References Cited

U.S. PATENT DOCUMENTS

| | | | |
|---|---|---|---|
| 337,872 | A | 3/1886 | Russell |
| 947,066 | A | 1/1910 | Tabour |
| 1,007,911 | A | 11/1911 | Bjorgum |
| 1,057,329 | A | 3/1913 | Clarus |
| 1,318,423 | A | 10/1919 | Williams |
| 1,322,514 | A | 11/1919 | Bader |
| 1,349,675 | A | 8/1920 | Johnson |
| 1,413,109 | A | 4/1922 | Feederle |
| 1,525,067 | A | 2/1925 | Browning |
| 1,625,994 | A | 4/1927 | Gorton |
| 1,846,156 | A | 2/1932 | Stange |
| 1,878,038 | A | 9/1932 | Frommer |
| 2,073,632 | A | 3/1937 | Green |
| 2,288,202 | A | 6/1942 | Mossberg |
| 2,370,189 | A | 2/1945 | Penney |
| 2,418,428 | A | 4/1947 | Rundquist |
| 2,418,946 | A | 4/1947 | Loomis |
| 2,453,977 | A | 11/1948 | Eames |
| 2,601,808 | A | 7/1952 | Clarke |
| 2,675,638 | A | 4/1954 | Crittendon |
| 2,685,754 | A | 8/1954 | Crittendon |
| 2,736,117 | A | 2/1956 | Clarkson et al. |
| 2,861,374 | A | 11/1958 | Hampton |
| 2,869,269 | A | 1/1959 | Couture |
| 2,926,446 | A | 3/1960 | Benson |

(Continued)

FOREIGN PATENT DOCUMENTS

| | | |
|---|---|---|
| DE | 708 197 C | 7/1941 |

OTHER PUBLICATIONS

European Supplementary Search Report dated Dec. 7, 2006 for European Patent Application No. 04809407.2.

*Primary Examiner*—Michael J. Carone
*Assistant Examiner*—Bret Hayes
(74) *Attorney, Agent, or Firm*—Womble Carlyle Sandridge & Rice, PLLC

(57) ABSTRACT

A locking system for firearms including a locking ring rotatably mounted to a bolt. As the bolt is moved through a bolt slide, the locking ring engages a cam member, which causes the locking ring to rotate about the bolt, which can remain fixed against rotation.

22 Claims, 6 Drawing Sheets

U.S. PATENT DOCUMENTS 2,941,449 A 6/1960 Reed
2,957,391 A 10/1960 Lovercheck
2,976,637 A 3/1961 Robinson, Jr.
3,080,793 A 3/1963 Montana
3,208,181 A 9/1965 Calhoun et al.
3,255,547 A 6/1966 Gregory, Jr.
3,285,133 A 11/1966 Fowler
3,299,812 A 1/1967 Suh et al.
3,344,712 A 10/1967 Colby
3,368,298 A 2/1968 Browning
3,397,473 A 8/1968 Browning
3,455,204 A 7/1969 Stoner
3,613,282 A 10/1971 Ramsay
3,619,926 A 11/1971 Alday
3,675,534 A 7/1972 Beretta
3,690,218 A 9/1972 Maillard
3,696,542 A 10/1972 Ekfeldt et al.
3,782,022 A 1/1974 Beilfeldt et al.
3,789,730 A 2/1974 Helmes
3,848,510 A 11/1974 Wolpert
3,866,513 A 2/1975 Hornfeck et al.
3,885,293 A 5/1975 Bateman, Jr. et al.
3,938,271 A 2/1976 Hyytinen
3,985,060 A 10/1976 Conley
3,996,684 A 12/1976 Bauman et al.
4,044,487 A 8/1977 Hutton et al.
4,135,434 A 1/1979 Hurlemann et al.
4,141,276 A 2/1979 Taylor et al.
4,172,410 A 10/1979 Anderson
4,305,218 A 12/1981 Godsey
4,329,908 A 5/1982 Rowlands
4,344,246 A 8/1982 Bauman et al.
4,389,919 A 6/1983 Kast et al.
4,445,292 A 5/1984 Martin
4,454,672 A 6/1984 Timari
4,527,459 A 7/1985 Childers
4,593,488 A 6/1986 Ruger
4,744,164 A 5/1988 Rieger
4,942,802 A 7/1990 Stoner
5,259,137 A 11/1993 Blenk et al.
5,289,653 A 3/1994 Szebeni et al.
5,458,046 A 10/1995 Blenk et al.
5,551,180 A 9/1996 Findlay et al.
5,682,007 A 10/1997 Dobbins
5,718,073 A 2/1998 Sache et al.
5,740,516 A 4/1998 Jiranek, II et al.
5,806,226 A 9/1998 Norton et al.
5,918,401 A 7/1999 Rowlands
5,987,798 A 11/1999 Ronkainen
6,189,253 B1 2/2001 Knight et al.
6,393,961 B1 5/2002 Ockenfuss
6,732,465 B2 5/2004 Strayer

BOLT ASSEMBLY WITH LOCKING SYSTEM

CROSS REFERENCE TO RELATED APPLICATIONS

The present patent application is a continuation of U.S. patent application Ser. No. 10/851,491, filed May 21, 2004, now U.S. Pat. No. 7,107,715 B2, which application claims the benefit of U.S. Provisional Application Ser. No. 60/473,277 entitled "Dual Lug Rotary Lockup" filed May 23, 2003, both applications being hereby specifically incorporated herein by reference.

FIELD OF THE INVENTION

The present invention generally relates to firearms, and in particular to a bolt assembly with a locking system for use in a repeating firearm.

BACKGROUND OF THE INVENTION

Most repeating firearms generally utilize a "rotary lock-up" bolt locking system in which a locking member rotates about a centerline of the barrel assembly, engaging and disengaging tabs or lugs with mating surfaces in the barrel assembly. The tabs, or lugs, traditionally have been integral components of the bolt head and are required to support the rearward axial load produced by the shell or cartridge when fired. As a result of this integral design, the entire bolt head assembly is required to rotate to engage and disengage the lugs. Firearms further must incorporate an extractor to pull the shell or cartridge out of the chamber when the bolt is opened, which extractor typically is mechanically attached the bolt head so as to rotate as an integral component of the bolt head assembly.

In the case of shotguns, the extractor is an appendage that extends beyond the face of the bolt head and as a result requires axial and radial clearances be formed in the barrel to accommodate such movement. Machining such radial clearances in the barrel has been and continues to be a difficult operation in the manufacture of rotary lockup barrel assemblies. Typical centerfire rotary lock up bolt assemblies therefore have recessed the extractor within the bounds of the bolt head to eliminate the requirement for axial or radial clearances in the barrel. In either case, the extractor engages the rim of the shell when the firearm is locked up and upon rotation of the bolt head from unlocked to locked or from locked to unlocked, the extractor must slide along the outside diameter surface of the shell or cartridge. Depending on the mechanical interface of the extractor and rim of the shell or barrel, significant malfunctions accordingly can occur. Ideally, the extractor engages the rim of the shell upon close up of the firearm and should remain stationary relative to the cartridge through the entire extraction process, thus reducing the potential for extraction malfunctions and as well as significantly reducing the difficulties in the manufacture of barrels with such axial and/or radial clearance for extractors.

Accordingly, it can be seen that a need exists for a bolt assembly and locking system for firearms that addresses the foregoing and other related and unrelated problems in the art.

SUMMARY

Briefly described, the present invention generally relates to a bolt assembly and locking system for firearms including long guns such as rifles and shotguns, although the principles of the present invention could be applied to other types of firearms including handguns and other firearms, for use in the extraction of a spent cartridge or shell and loading of a live round of ammunition within the chamber of the firearm. In general, the bolt assembly with locking system of the present invention will include a housing or bolt slide having an internal chamber or passage in which a rotary locking lug or member and bolt are received. The rotary locking lug or member includes a cylindrical body portion that is received and is movable along the passage of the bolt slide, and a forward locking ring or section attached to the body. One or more helical slots are formed in the body of the rotary locking lug behind the locking ring, with the rotary locking member being designed to rotate with respect to the bolt slide and bolt as it is translated and moved longitudinally along the passage of the bolt slide. The rotary locking lug further includes a longitudinally extending passage or channel through the locking ring and body thereof.

The bolt includes a cylindrical bolt body adapted to be received and be movable longitudinally through the passage of the bolt slide, and a bolt head attached to a first or forward end of the bolt body. An extractor typically is attached to the bolt head for engaging and extracting a spent cartridge or shell during operation of the locking system of the present invention upon firing of a round of ammunition. A firing pin passage or channel further is formed through the bolt and bolt head, in which a firing pin for the firearm is received and can slide so as to engage or contact a round of ammunition for firing the round. A longitudinal slot generally is formed along the upper portion of the bolt body so as to at least partially coincide with the helical slot formed in an upper portion of the rotary locking lug as the bolt translates through the rotary locking lug.

A cam member or assembly, which can include one or more cam pins, is received through the bolt slide so as to engage the helical slot(s) of the rotary locking member/lug and the longitudinally extending slot of the bolt. Engagement of the cam member with the longitudinal slot of the bolt prevents the bolt from twisting or rotating with respect to the bolt slide while enabling the longitudinal or translational movement of the bolt along the passage of the bolt slide during operation of the system of the present invention. At the same time, the engagement of the cam member in the helical slot of the rotary locking lug causes the rotary locking lug to be rotated with respect to the bolt head during movement of the bolt and rotary locking lug along the passage of the bolt slide while the bolt head remains generally fixed against substantial rotation.

In operation, as a round of ammunition is discharged and the action sleeve assembly of the firearm is driven rearwardly, carrying the bolt slide rearwardly while the cam member contained therewithin engages the helical slot(s) of the locking ring so as to cause the rotation thereof while the bolt head remains fixed against rotation as the bolt slide moves therealong. As the complete bolt assembly translates rearwardly, the extractor will engage the rim of the spent or fired shell or cartridge and pull the cartridge from the chamber until it contacts ejection surfaces of the carrier of the firearm at which time the cartridge is ejected from the firearm. As a next live round is fed from the magazine, the bolt slide is released and moves forwardly until the round is fully seated within the chamber of the firearm stopping the forward motion of the bolt head and rotary locking lug.

Various objects, features, and advantages of the present invention will become apparent to those skilled in the art when taken upon review of the following specification, when taken in conjunction with the accompanying drawings.

DESCRIPTION OF THE INVENTION

Figure 1:
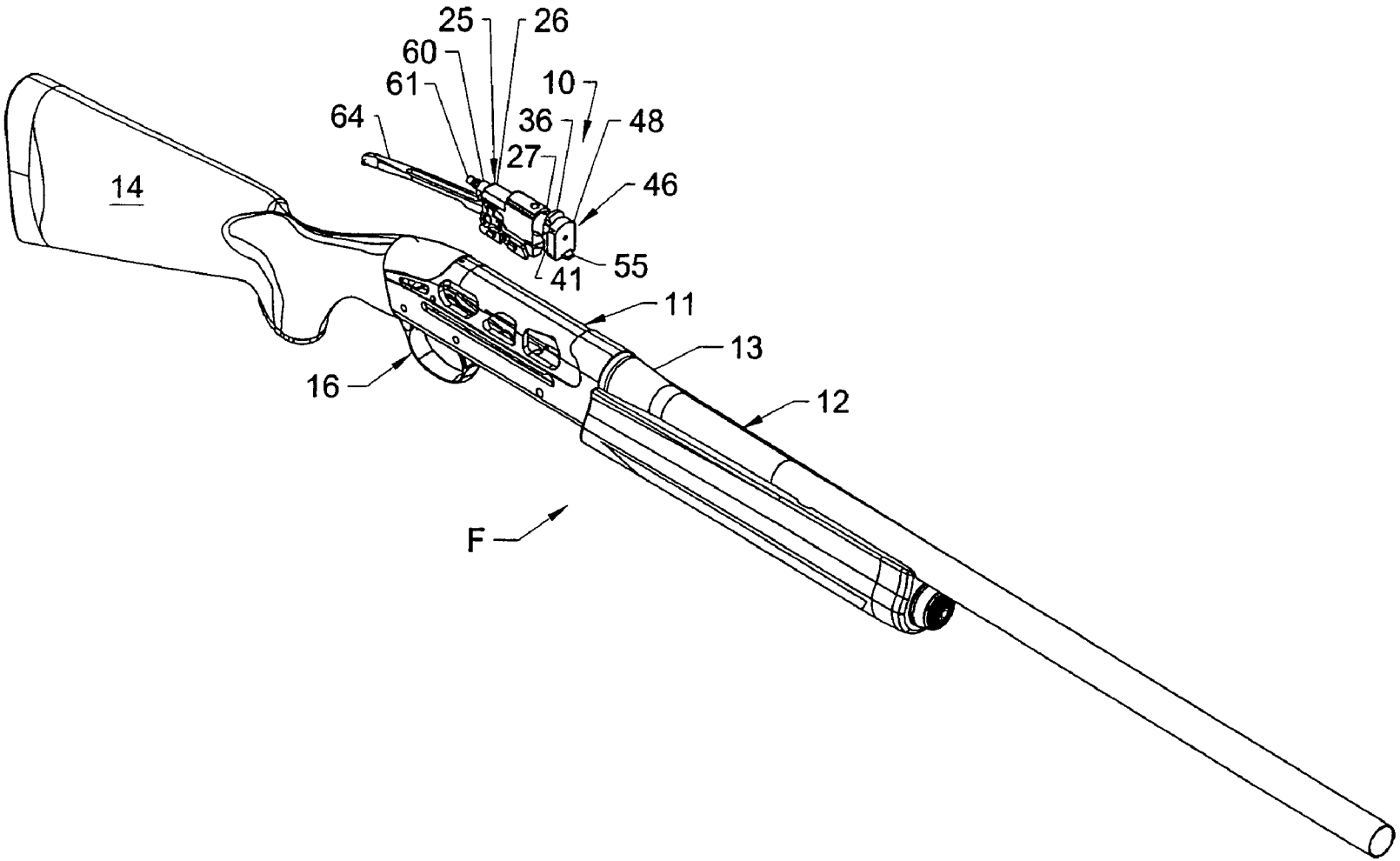
FIG. 1 is a perspective view of a firearm and the bolt assembly and the locking system of the present invention.

To accomplish a consistent interface between the extractor and a shell or cartridge, the extractor should not rotate, which in turns requires that rotation of the bolt head should be limited as well. Therefore, the present invention is directed to a bolt assembly and locking system 10 for firearms F, that is designed to maintain the extractor alignment with respect to a cartridge or shell to be extracted while still providing a rotating locking lug for engagement with the barrel, with the bolt head/extractor unit generally being substantially mounted/fixed against rotation. FIGS. 1–5B show the components of the bolt assembly 10 according to one example embodiment of the present invention. As shown in FIG. 1, the bolt assembly 10 can be used with various types of firearms, such as an auto-loading shotgun and other types of long guns, having a receiver 11 in which the bolt assembly 10 is mounted, a barrel 12, having a chamber 13 defined therein, stock 14, a fire control or trigger assembly 16, an action sleeve assembly 17 (FIG. 2B) on which the bolt assembly is carried, and a carrier 18 (FIG. 2A), for loading a cartridge or round of ammunition 19. It will further be understood that the principles of the present invention can be applied to other types of firearms, including hand guns.

Figure 2A:
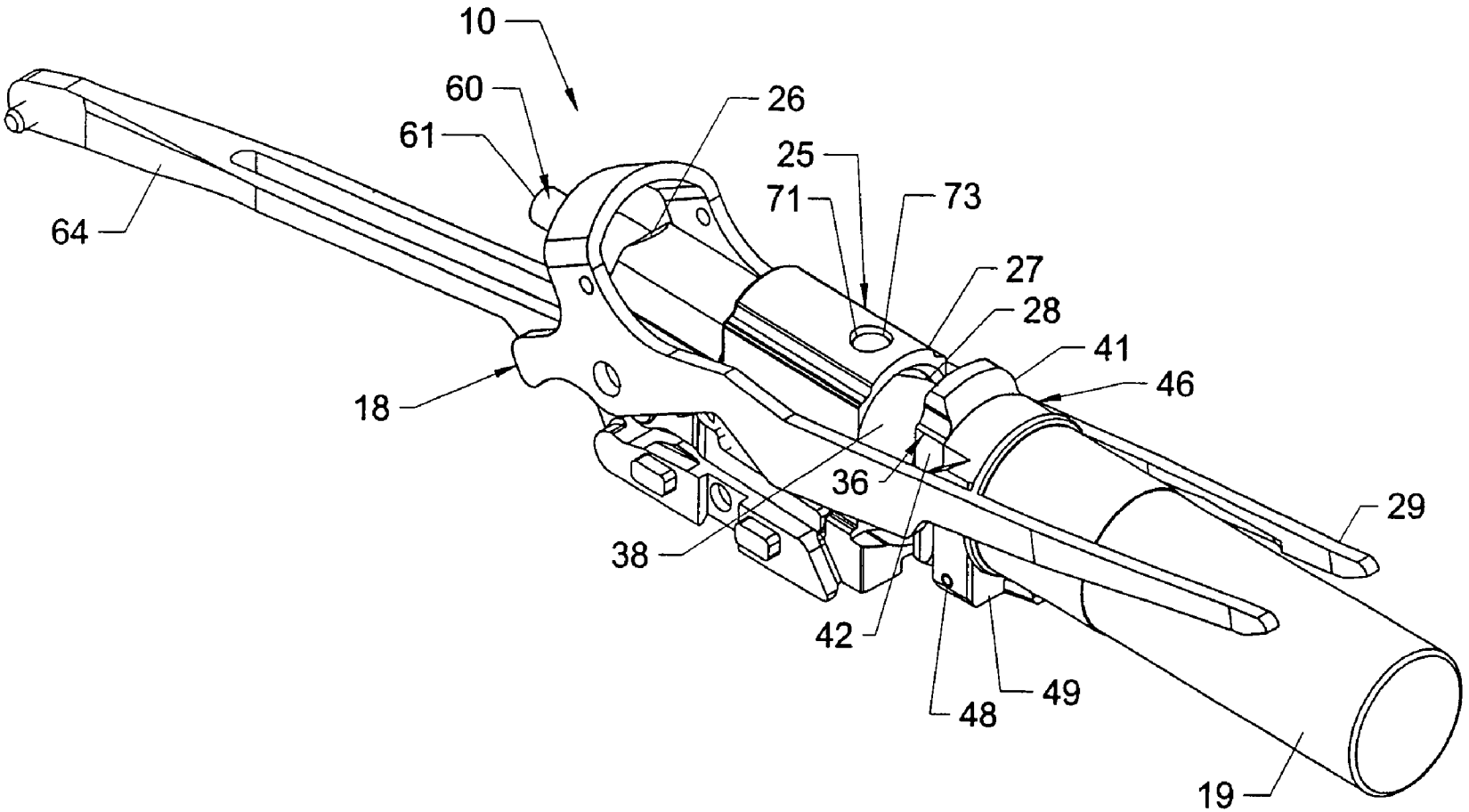
FIG. 2A is a perspective view of the action sleeve and bolt assembly of a firearm.
Figure 2B:
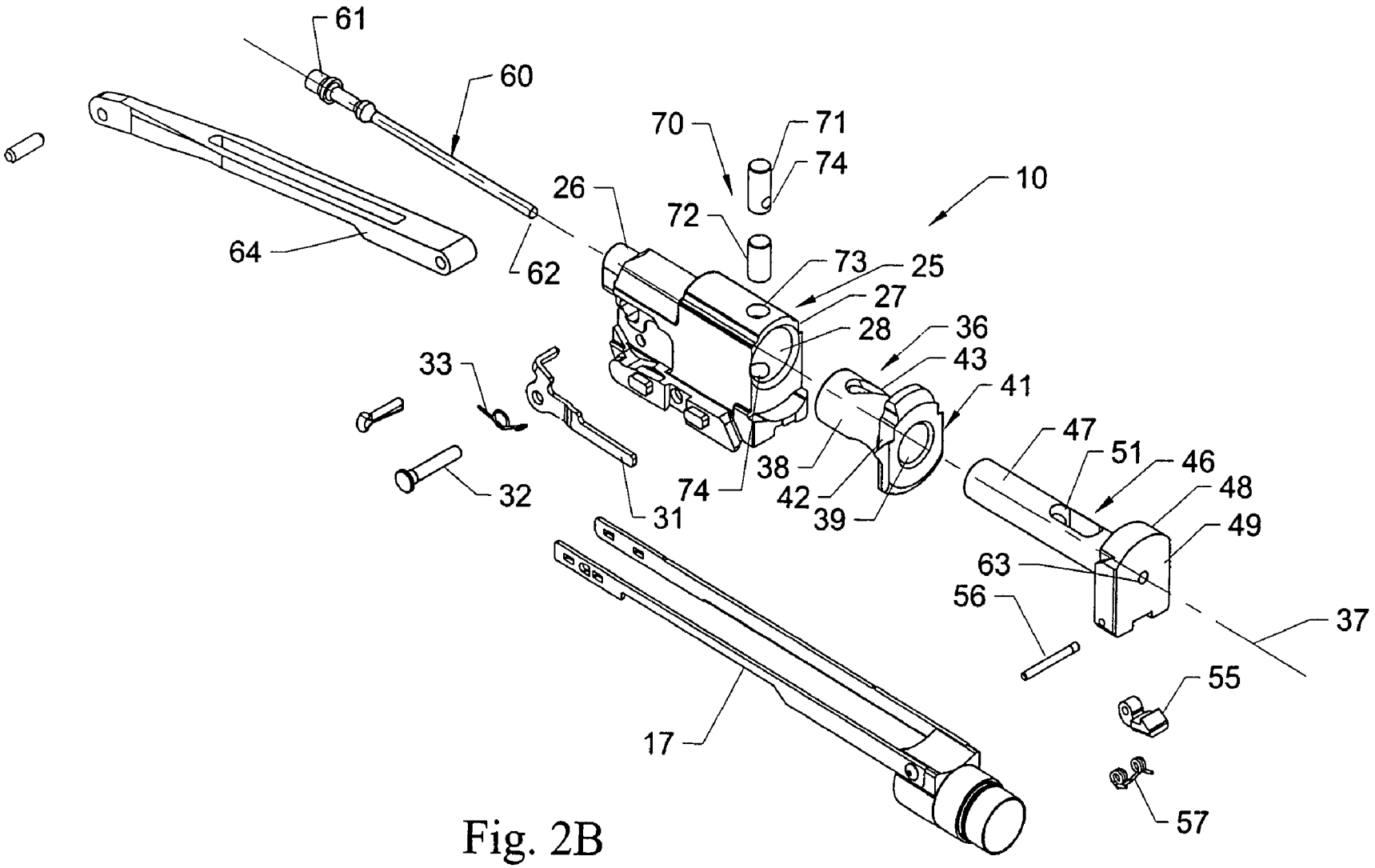
FIG. 2B is an exploded perspective illustration of the bolt assembly and locking system of the present invention.
Figure 3:
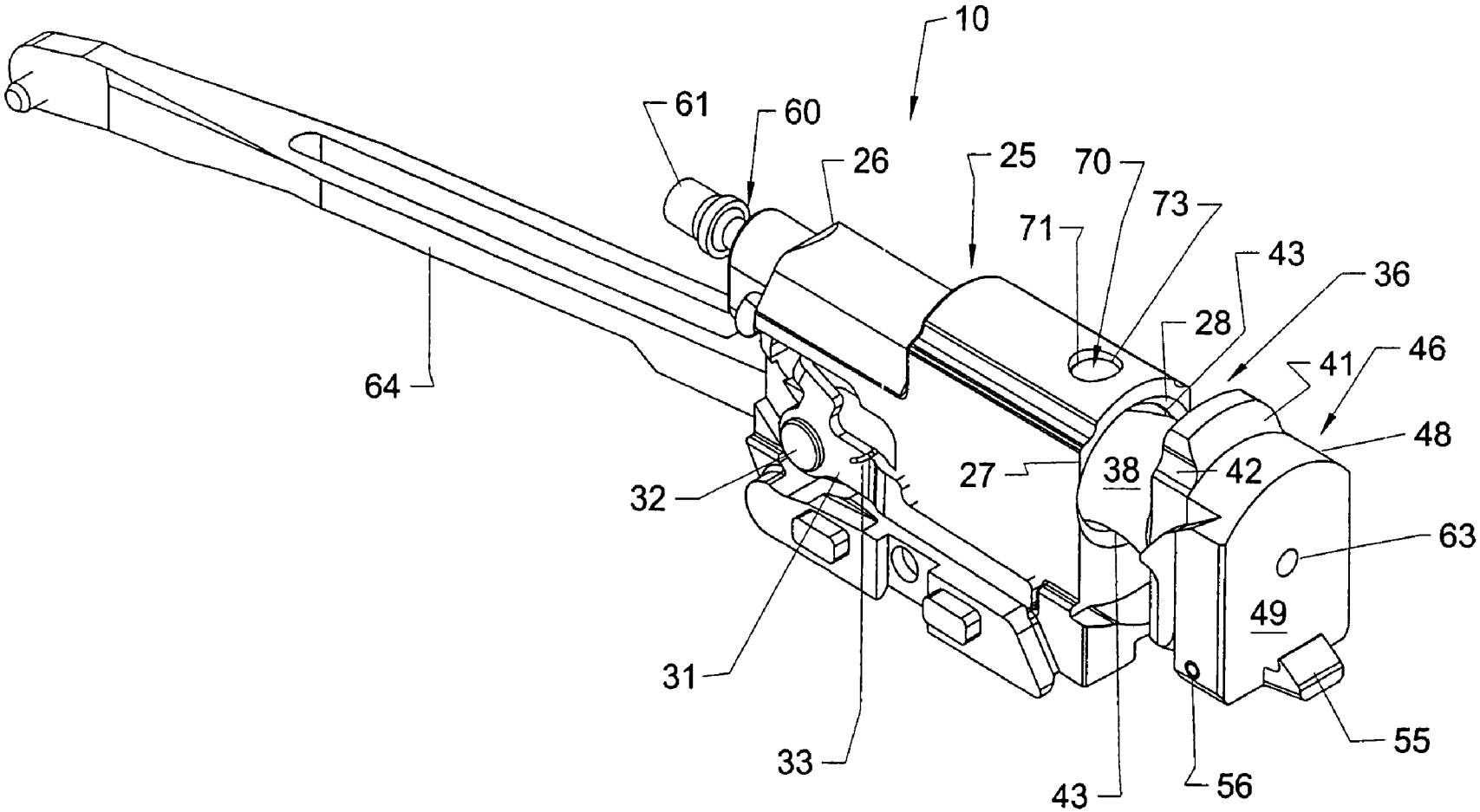
FIG. 3 is a perspective view of the bolt assembly and locking system of the present invention.

As shown in FIGS. 2A–3, the bolt assembly 10 with the locking system of the present invention generally includes a bolt slide 25 or housing, typically formed from a high strength metal material such as steel, which includes a first, rearward or distal end 26 and a second, forward or proximal end 27 with a central passage or counter bore 28 extending therethrough from the forward or proximal end 27 toward the rear end 26. The bolt slide generally is mounted on the action sleeve assembly so as to be moved or translated through the receiver with the movement of the action sleeve assembly upon firing of a round of ammunition. As shown in FIG. 2A, the carrier 18 generally is pivotally attached to the receiver and includes a pair of longitudinally extending arms or tabs 29 adapted to engage the round of ammunition 18 for loading the round through the receiver and into the chamber of the firearm. A carrier support 31 is pivotally attached to a side surface of the bolt slide 25 by pivot pin 32, as indicated in FIG. 2B, and generally is biased by a spring member 33 into a lowered, resting position.

As shown in FIGS. 2B–5B, a rotary locking member or locking lug 36 is slidably received within the passage or channel 28 of the bolt slide. The locking lug is rotatable about a longitudinal axis, shown at phantom lines 37 in FIG. 2B, with respect to the bolt slide, and includes a substantially cylindrical body portion 38 defining a central passage or channel 39. The locking lug further includes a locking ring 41 mounted to a forward portion thereof. The locking ring 41 generally is a plate that is formed with or mounted to the body portion 38 and includes lug or cam surfaces 42 about its peripheral edge for engaging in rotating the arms 29 (FIG. 2A) of the carrier 18 to a raised position for engaging and extracting the spent or fired cartridge of the round of ammunition 19 from the chamber. In addition, at least one helical slot 43 is formed through the body portion 38, extending about the body portion from the rear end thereof toward the locking ring in a spiral or helical configuration. One or more helical slots can be used, typically with one extending across an upper portion of the body along the side to a point along the lower portion of the body as indicated in FIG. 2B.

As shown in FIGS. 2B, 3, and 5A–5B, a bolt 46 is slidably received through the channel 39 of the locking lug and the bolt slide passage or bore 28. The bolt 46 generally is formed from a metal such as steel and includes a rearwardly extending body portion 47 with a bolt head 48 attached to a forward or front portion of the body and defining a bolt face 49. At least one longitudinal slot 51 is formed in the bolt body 47 (FIG. 2B), typically extending along an upper portion thereof and will be aligned or will coincide with the at least one helical slot 43 formed in the locking lug 36. An extractor 55 is mounted to the bolt face 49 by a pivot pin 56, and typically is biased to a raised, engaging position by a spring 57 to engage the rim of a cartridge or shell within the chamber of the firearm in a locking engagement for extraction of the cartridge.

Figure 5A:
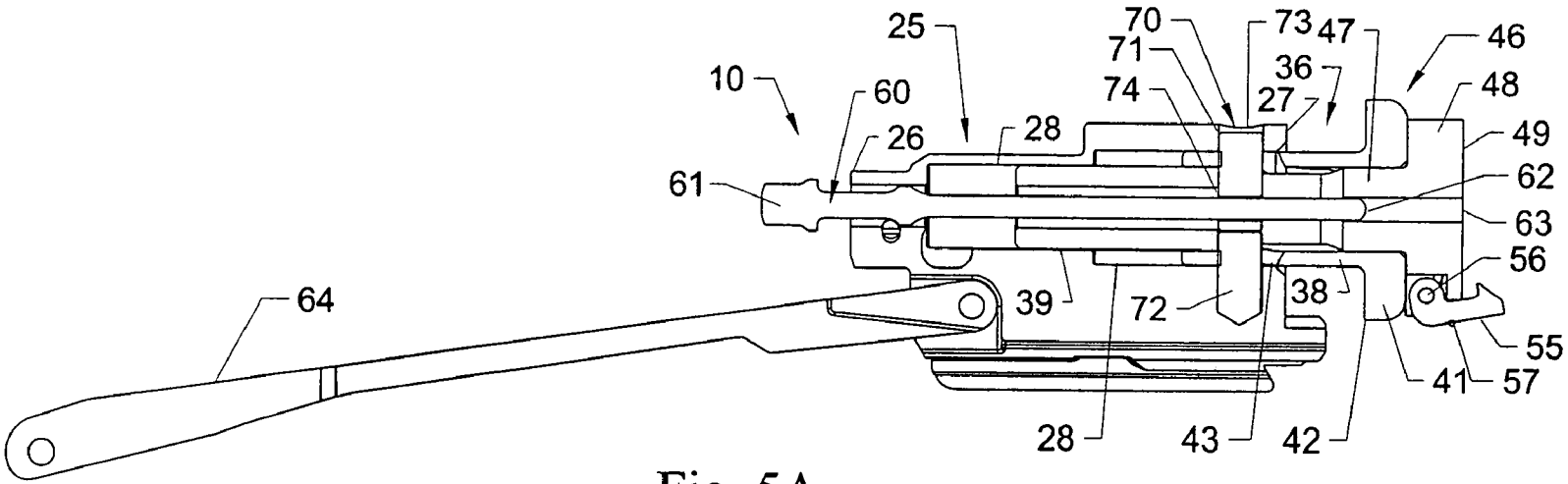
FIGS. 5A and 5B are side elevational views, taken in partial cross-section, of the bolt assembly with locking system of the present invention.
Figure 5B:
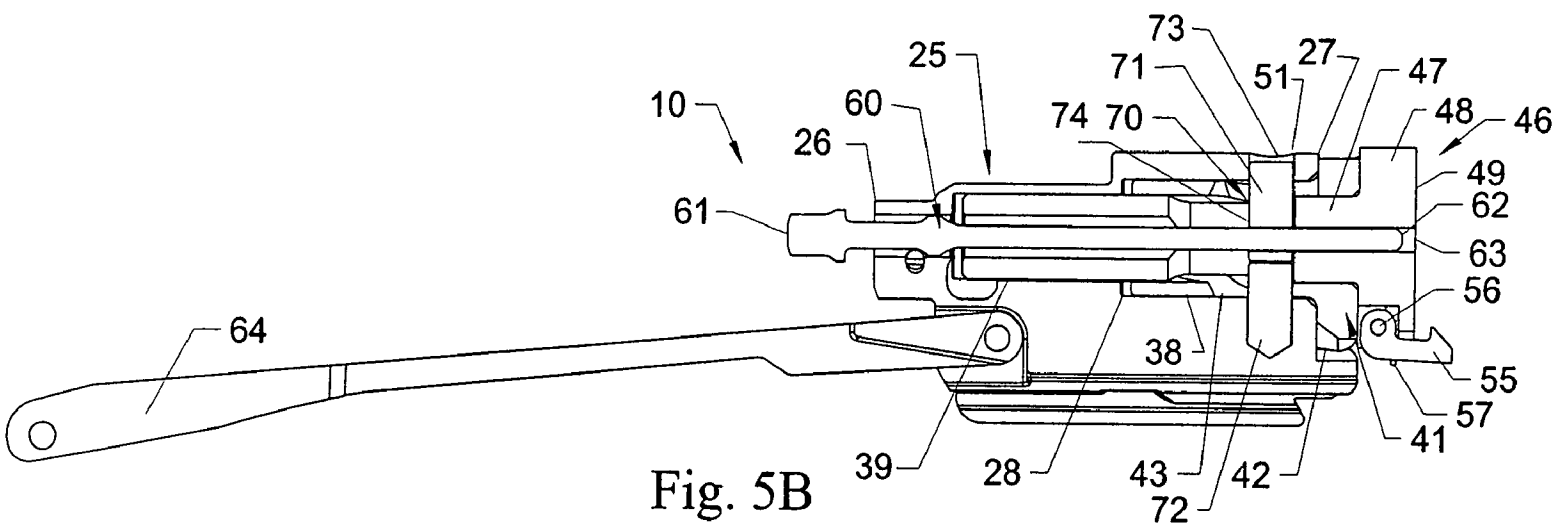

As further indicated in FIGS. 2B and 5A–5B, a firing pin 60 having a rear end 61 and a forward end or tip 62 is received through the bolt slide, locking lug and bolt, extending through the passages of the bolt slide and locking lug and through a firing pin bore or passage 63 formed through the bolt 46. Additionally, a linkage 64 is pivotally attached to the rear end 26 of the bolt slide 25 to help control the sliding or translational movement of the bolt assembly 10 during extraction and loading of a spent shell/live round of ammunition after firing.

As further indicated in FIGS. 2B and 5A and 5B, a cam member or assembly 70 is provided for engaging and causing rotation of the rotary locking lug 36. In one embodiment illustrated in the drawings, the cam member 70 generally comprises a pair of cam pins 71 and 72 that are received within a vertical passage 73 (FIGS. 5A and 5B) formed through the bolt slide 25 and project into the bore or passage 28 of the bolt slide so as to engage the locking lug and bolt. It will also be understood that while a pair of cam pins are shown, it is also possible to use a single cam pin or rod as well. The upper cam pin 71 further is shown with a transverse bore 74 (FIG. 2B) formed therein, through which the firing pin 60 is received and guided along its longitudinal movement through the bolt assembly. The cam pins engage the helical and longitudinal slots 43 and 51 of the locking lug 36 and bolt 46, respectively, so as to cause the rotation of the locking ring 41 of the locking lug, while maintaining the bolt and bolt head, and thus the extractor, in a position substantially fixed against rotation with respect to the cartridge or shell within the chamber during an extraction and loading operation of the bolt assembly of the present invention.

Figure 4A:
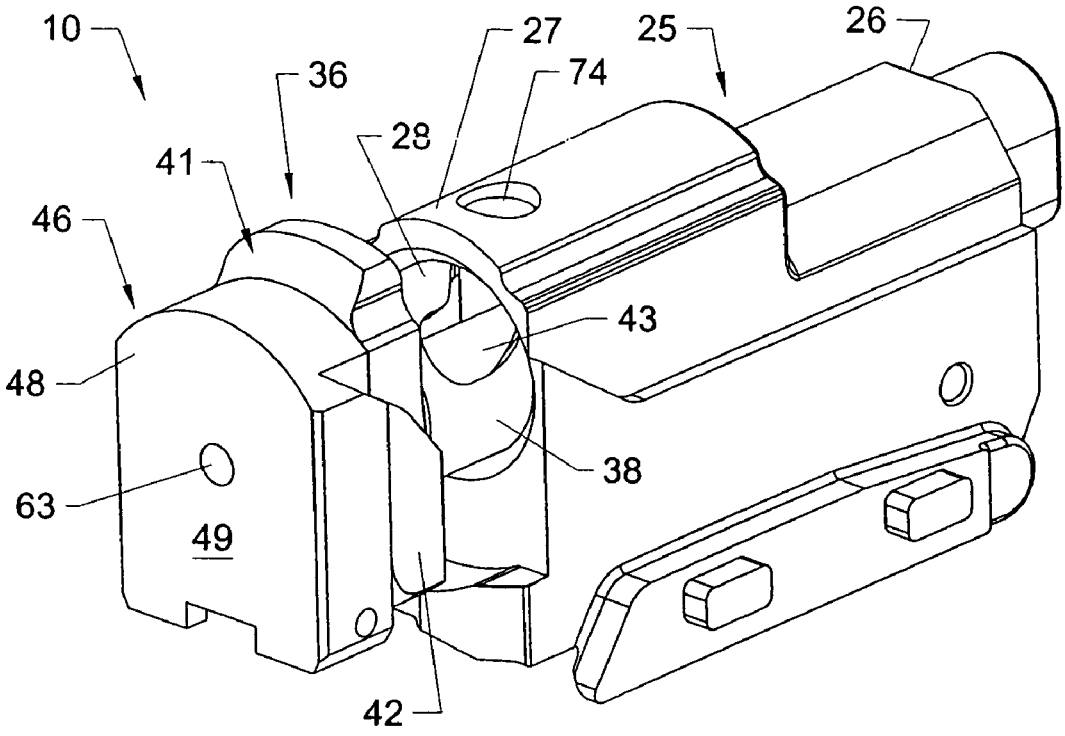
FIGS. 4A and 4B are perspective views of the bolt, locking member and bolt slide of the present invention.
Figure 4B:
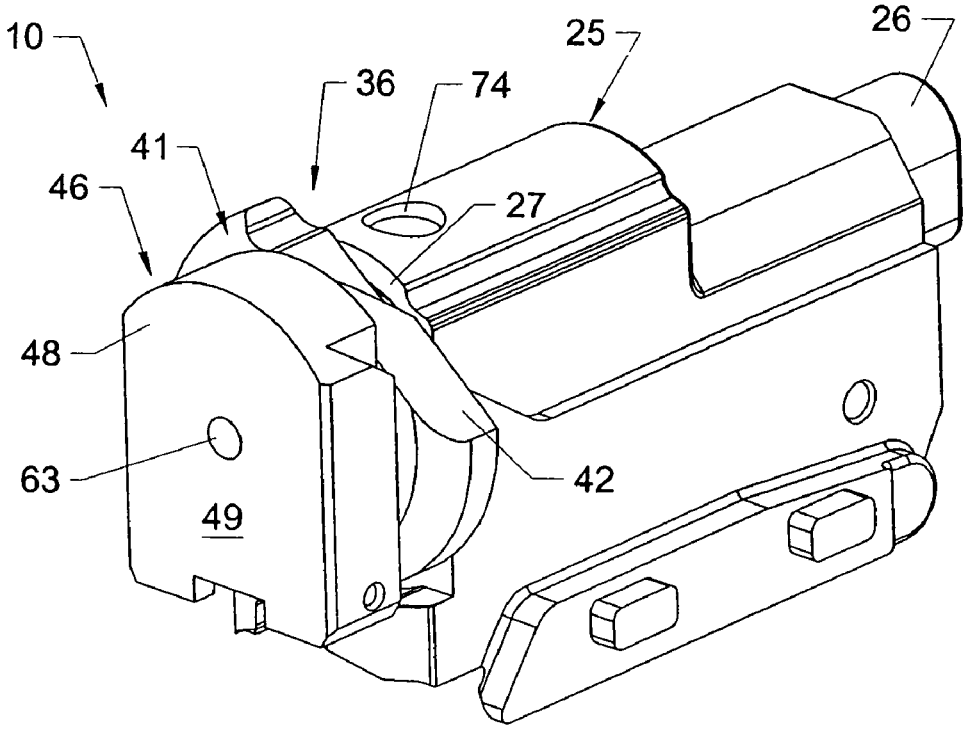

As indicated in FIGS. 4A–4B, the locking lug 36/locking ring 41 slide along and rotate about the shaft of the bolt 46, with both of these components, being received within and moveable along the counter bore or passage 28 of the bolt slide 25. The longitudinal slot 51 (FIG. 4A) and helical slot(s) 43 of the bolt and locking lug 38, respectively, mate with the cam pin or pins 71/72, which are supported within the passage 28 of the bolt slide. FIGS. 4A and 5A show the bolt assembly in the "unlocked" mode, that is, the bolt 46 is fully extended from the bolt slide 25, limited by contact with the cam pins 71/72. The locking lug 36 is also fully extended as well, with the locking ring 41 against the bolt head and its lug or cam surfaces 42 oriented in the vertical plane. FIG. 4B shows the bolt assembly in the "locked up" mode, that is, the bolt head and locking ring are fully seated within and against the front end face 27 of the bolt slide. As it is moved to its locked position as shown in FIG. 4B, the locking ring is rotated such that its lug or cam surfaces will engage mating pockets within the barrel assembly and will urge the carrier to a raised position to eject the spent or fired round or cartridge from the chamber.

As the bolt assembly then translates within the firearm towards the shell or cartridge, the bolt head and locking ring remain in the unlocked position until the shell or cartridge is firmly seated within the chamber of the firearm. At that point, as the shell or cartridge becomes fully seated in the chamber, the bolt head and locking ring cease their forward, longitudinal movement. The bolt slide 25, however, continues to translate forward, with its cam pin(s) engaging and moving (FIG. 2B) along the slots 51 and 43 of the bolt and locking lug, respectively. Due to the helical configuration of the slot(s) of the locking lug, the axial translation of the bolt slide/cam pins causes the locking ring to be rotated about the bolt head into its locked position as shown in FIGS. 2A, 4B and 5. The axial translation or movement of the bolt slide thereafter stops when the locking ring is fully rotated and seated against the bolt slide.

In operation of the bolt assembly 10 of the present invention, as indicated in FIGS. 3–5B, as the trigger of the firearm is squeezed, it releases the hammer of the firearm, which in turn impacts or strikes the firing pin. Upon impact, the firing pin 60 translates forwardly so as to strike the primer of the round of ammunition loaded within the chamber, causing the round to fire. The shot column generated from the fired round of ammunition progresses down the bore of the barrel of the firearm, due to gas pressure from the burning powder, with a portion of the gases generated thereby being redirected rearwardly through ports in the barrel so as to drive the action sleeve assembly 17 (FIG. 2B) on which the bolt slide 25 of the bolt assembly 10 with locking system of the present invention is mounted. As the bolt slide is thus carried or translates rearwardly through the receiver of the firearm, the cam pins 71 and 72 (FIGS. 5A and 5B) engage and slide along the helical slot or slots 43 of the locking lug, while at the same time moving longitudinally along the longitudinal slot 51 of the bolt 46. As a result of the engagement of the cam pins within the longitudinal and helical slot(s) of the bolt and locking lug, respectively, the locking ring is caused to rotate counterclockwise, while the bolt head is restricted from rotating. The locking ring will be rotated until the cam pins meet the ends of the helical slot(s) of the locking lug.

Upon completion of the locking ring rotation, the cam pins 71 and 72 generally will be at the rear end of the mating slots 43 and 51 of the locking lug and bolt, respectively, and thus further rearward translation or movement of the bolt slide will impart a rearward movement to the locking ring and bolt head. As the complete bolt assembly 10 is translated rearwardly, the extractor 55 engages the rim of the fired shell or cartridge and pulls the shell from the chamber of the firearm. The spent shell or cartridge and the bolt assembly continue moving rearwardly until the rim of the shell contacts the ejection surfaces of the arms or prongs of the carrier, at which time the spent shell is forced to rotate downwardly and is ejected out of the receiver of the firearm, while the bolt assembly continues to move rearwardly so as to engage the carrier, wherein it imparts a clockwise rotation to the carrier to position the carrier prongs downwardly below the magazine so as to receive a next live round of ammunition from the magazine.

The bolt slide continues its rearward movement until contact is made between the rear end or face 26 of the bolt slide and the inside face of the firearm receiver. As the next live round of ammunition is released from the magazine, it typically is urged rearwardly due to the magazine spring force and contacts a bolt stop release button on the front of the trigger plate of the firearm fire control, in response to which the bolt slide is released and begins a forward movement through the receiver. As the bolt slide moves forwardly, mating surfaces of the bolt slide and carrier cause the carrier to be rotated counterclockwise so as to raise and align the live round of ammunition with the chamber, with the entire bolt assembly continuing forwardly until the round is fully seated within the chamber of the firearm, which stops the forward motion of the bolt head and locking ring. The bolt slide further continues forwardly with its cam pins 71 and 72 engaging the helical slot(s) of the locking lug so as to cause the locking ring to be rotated in a clockwise direction as indicated in FIG. 4B, with the prongs or arms of the carrier being positioned above the bolt slide as indicated in FIG. 2A.

It will be further understood by those skilled in the art that while the foregoing has been disclosed above with respect to preferred embodiments or features, various additions, changes, and modifications can be made to the foregoing invention without departing from the spirit and scope of thereof.

What is claimed is:

1. A method of operating a bolt assembly for a firearm, comprising:

providing a firearm comprising: a barrel having a firing chamber; a receiver; a bolt slide; a bolt slidably received within the bolt slide; and a locking member;

advancing the bolt toward the firing chamber to chamber a round of ammunition in the firing chamber;

locking the bolt at a rear of the firing chamber with the locking member, wherein a bolt face of the bolt is adjacent to the round of ammunition; and firing the round of ammunition, whereupon the bolt moves towards a rear of the receiver and remains substantially fixed against rotation about a longitudinal axis of the bolt, with respect to the barrel, wherein locking the bolt comprises rotating the locking member about the bolt in a first direction.

2. The method of claim 1, wherein rotating the locking member about the bolt comprises engaging at least one locking lug of the locking member with a mating pocket in the firearm.

3. The method of claim 2, further comprising unlocking the bolt after firing the round of ammunition.

4. The method of claim 3, wherein unlocking the bolt comprises rotating the locking member about the bolt in a second direction opposite to the first direction.

5. The method of claim 1, wherein rotating the locking member about the bolt comprises rotating the locking member within the bolt slide.

6. The method of claim 5, wherein rotating the locking member about the bolt comprises engaging a cam pin in a slot of the locking member.

7. The method of claim 1, wherein firing the round of ammunition comprises moving a firing pin through the bolt so that the firing pin strikes the round of ammunition.

8. The method of claim 1, wherein the locking member comprises a locking ring and at least one helical slot formed therein.

9. The method of claim 8, wherein rotating the locking member comprises engaging a cam assembly in the bolt slide with the helical slot in the locking member as the bolt slide moves longitudinally with respect to the bolt.

10. The method of claim 1, wherein rotating the locking member about the bolt comprises rotating the locking member within the bolt slide.

11. The method of claim 1, further comprising extracting the round of ammunition with an extractor mounted on the bolt.

12. The method of claim 1, wherein the bolt remains substantially fixed against rotation about a longitudinal axis of the bolt, with respect to the barrel, while advancing the bolt toward the firing chamber to chamber the round of ammunition.

13. A method of operating a bolt assembly for a firearm, comprising:

providing a firearm comprising: a barrel; a firing chamber; a bolt slide having a bolt slide passage; a locking member at least partially received within the bolt slide passage; and a bolt extending through the locking member, the bolt having a bolt face;

advancing the bolt toward the firing chamber to chamber a round of ammunition in the firing chamber;

rotating the locking member in a first direction about the bolt to lock the bolt with the locking member so that the bolt face is adjacent to the chambered round of ammunition;

firing the round of ammunition, whereupon the bolt slide moves towards a rear of a receiver; and unlocking the bolt after firing the round of ammunition by rotating the locking member about the bolt in a second direction opposite to the first direction.

14. The method of claim 13, wherein rotating the locking member in the first direction comprises rotating the locking member about a longitudinal axis of the locking member, wherein the locking member rotates with respect to the barrel, the bolt slide, and the bolt.

15. The method of claim 14, wherein the bolt remains substantially fixed against rotation about a longitudinal axis of the bolt, with respect to the barrel, after firing the round of ammunition.

16. The method of claim 14, wherein unlocking the bolt comprises engaging a cam member with the locking member to cause the rotation in the second direction.

17. The method of claim 16, wherein unlocking the bolt further comprises moving the bolt slide toward a rear of the receiver after firing the round of ammunition, the rearward movement of the bolt slide causing the cam member to rotate the locking member.

18. The method of claim 14, wherein the bolt slide moves longitudinally with respect to the bolt and the locking member.

19. The method of claim 18, wherein the locking member is located between the bolt slide and the bolt.

20. A method of operating a bolt assembly for a firearm, comprising:

providing a firearm comprising: a firing chamber; a bolt slide; a bolt having a bolt face; and a locking member located between the bolt and the bolt slide and at least partially received within the bolt slide;

providing a round of ammunition chambered within the firing chamber with the bolt face adjacent to the round of ammunition at a rear of the firing chamber;

firing the round of ammunition;

moving the bolt slide in a longitudinal direction toward a rear of a receiver while the bolt face remains at a rear of the firing chamber;

as the bolt slide moves rearwardly, rotating the locking member about the bolt by engaging a member of the bolt slide with the locking member, wherein the locking member rotates with respect to a barrel, the bolt slide, and the bolt; and after rotating the locking member about the bolt, moving the bolt and the locking member toward the rear of the receiver.

21. The method of claim 20, wherein the bolt remains substantially fixed against rotation about a longitudinal axis of the bolt, with respect to the barrel, after firing the round of ammunition.

22. The method of claim 20, wherein rotating the locking member disengages at least one locking lug of the locking member with a mating pocket in the firearm.

* * * * *